US008128251B2

(12) United States Patent
Huang et al.

(10) Patent No.: US 8,128,251 B2
(45) Date of Patent: Mar. 6, 2012

(54) LIGHTING APPARATUS

(75) Inventors: Chuan Tim Huang, Kaohsiung County (TW); Hung Chun Li, Taoyuan County (TW); Yeu Torng Yau, Tainan (TW); Li Ling Lee, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/457,717

(22) Filed: Jun. 19, 2009

(65) Prior Publication Data

US 2009/0316391 A1 Dec. 24, 2009

(30) Foreign Application Priority Data

Jun. 20, 2008 (TW) ..... 97123126 A

(51) Int. Cl.
*F25D 27/00* (2006.01)
*F21V 29/00* (2006.01)

(52) U.S. Cl. ..... 362/126; 362/294; 362/125; 362/92

(58) Field of Classification Search ..... 362/92, 362/125, 126, 294, 133; 312/116, 223.5
See application file for complete search history.

(56) References Cited

U.S. PATENT DOCUMENTS

| | | | | |
|---|---|---|---|---|
| 6,179,434 | B1 * | 1/2001 | Saraiji | 362/125 |
| 6,558,017 | B1 * | 5/2003 | Saraiji et al. | 362/125 |
| 7,121,675 | B2 * | 10/2006 | Ter-Hovhannisian | 362/92 |
| 7,513,637 | B2 * | 4/2009 | Kelly et al. | 362/126 |
| 7,824,055 | B2 * | 11/2010 | Sherman | 362/125 |
| 7,824,057 | B2 * | 11/2010 | Shibusawa et al. | 362/125 |
| 7,954,979 | B2 * | 6/2011 | Sommers et al. | 362/217.01 |
| 2008/0186696 | A1 * | 8/2008 | Awai et al. | 362/92 |

FOREIGN PATENT DOCUMENTS

WO 2008/058086 A2 5/2008

* cited by examiner

*Primary Examiner* — Peggy A. Neils
(74) *Attorney, Agent, or Firm* — Bacon & Thomas, PLLC

(57) ABSTRACT

The present invention provides an integrated lighting apparatus including a main frame constructed by at least a first frame wall, a second frame wall adjacent to the first frame wall and a third frame wall adjacent to the second frame wall and opposite to the first frame wall. The first, second and third frame walls define an interior space for receiving a lighting device therein. The main frame is integrated with a heat-dissipating portion extending from a first side of the first frame wall. The interior space is covered with the lampshade. Through the heat-dissipating portion, the lighting apparatus is detachably combined with the refrigerated display cabinet in a simple and convenient manner.

7 Claims, 5 Drawing Sheets

LIGHTING APPARATUS

BACKGROUND OF THE INVENTION

1. Field of the Invention

The present invention relates to a lighting apparatus, and more particularly, to a lighting apparatus for use with a refrigerated display cabinet.

2. Description of the Related Art

Lights installed in a refrigerated display cabinet are used for illuminating merchandise, so that the products stored therein are well displayed and then sold to customers. Generally, the lights are installed underneath the front end of a cabinet shelf plate portion. In this case, the customers can have a clear view of the products illuminated. Today, lights for use with refrigerated display cabinets are mostly fluorescent lamps, which radiate light in 360 degrees, and as many experimental results show, fluorescent lamps have a power consumption of about 40 W and a luminous efficiency between 40% and 65%. Such results indicate that rather than being effectively transmitted to the products requiring illumination, much of the light is being shaded during the process. This means that much of the energy is wasted. Besides, much of the light energy is dissipated even though light rays are reflected back.

Furthermore, fluorescent lamps installed in refrigerated display cabinets have other drawbacks: they are generally more difficult to activate, provide poor color rendering, have poor luminous efficiency under low temperature, and pose a risk of mercury poisoning. Refrigerated display cabinets are generally used for storing food, which may be subject to mercury poisoning when fluorescent lamps are installed within.

In addition, product price tags are often placed at the front end of a cabinet shelf plate, too. Trouble may thus arise with arranging the positions of price tags and lights. Generally, price tags are placed or clamped at the front end of shelf plate, while lights are fixed to the rear of the price tags. As a result, it may cause inconveniences for maintenance work.

SUMMARY OF THE INVENTION

Compared with fluorescent lamps, light emitting diodes (LEDs) have longer lifetime and provide higher color rendering index with adjustable color temperature. Besides, LEDs are free from the risk of mercury poisoning, and have better luminous efficiency even under low temperature. Thus, the drawbacks with fluorescent lamps will be overcome when LEDs are used in a refrigerated display cabinet instead. To utilize energy more efficiently, the present invention takes advantage of the directional nature pertaining to LED lighting to avoid dissipation of light energy and thus increase luminous efficiency. As such, an object of the present invention is to provide a lighting apparatus, which, compared with a conventional fluorescent lamp, is more compact in size and has simpler structure that makes assembly easier. Moreover, the lighting apparatus of the present invention is advantageous in terms of energy conservation.

Another object of the present invention is to provide an integrated lighting apparatus manufactured by a metal extrusion process such as an aluminum extrusion process, so that the frame and heat sinks will form a one-piece structure. Heat can be dissipated better with the one-piece metal extrusion lighting apparatus, and besides, price tags can be held on the first clamping portion of the first frame wall. Therefore, the lighting apparatus of the present invention is advantageous in increasing heat dissipation efficiency, lowering manufacture cost, simplifying assembly procedures, and making maintenance work more convenient.

The mentioned objects are achieved by the lighting apparatus of the present invention. The lighting apparatus is installed in a refrigerated display cabinet, and includes: a main frame constructed by at least a first frame wall, a second frame wall adjacent to the first frame wall and a third frame wall adjacent to the second frame wall and opposite to the first frame wall, thereby defining an interior space for receiving a lighting device therein, and integrated with a heat-dissipating portion extending from a first side of the first frame wall; and a lampshade configured for covering the interior space. The lighting apparatus is detachably combined with the refrigerated display cabinet with the heat-dissipating portion.

Preferably, the main frame includes an engagement portion formed on a second side of the first frame wall and one side of the third frame wall corresponding to the second side of the first frame wall, and the lampshade is engaged with the engagement portion at a first rim and a second rim thereof.

Preferably, the lighting apparatus further includes a holding portion formed on a surface of the second frame wall for holding a card or a tag.

Preferably, the heat-dissipating portion has a plurality of grooves or fins formed thereon.

Preferably, the heat-dissipating portion is extending from the first frame wall at an angle less than 90 degrees relative thereto.

Preferably, the heat-dissipating portion includes a first and a second heat sinks which are parallel to each other, and the lighting apparatus is detachably combined with the refrigerated display cabinet by means of clamping by the first and second heat sinks.

Preferably, the heat-dissipating portion includes a heat sink extending from the second frame wall, and the lighting apparatus is detachably combined with the refrigerated display cabinet by means of attaching thereto by the heat sink.

Preferably, the lighting device is a light-emitting diode assembly.

Preferably, the lampshade is made of transparent material or a translucent material.

BRIEF DESCRIPTION OF THE DRAWINGS

The above objects and advantages of the present invention will become more readily apparent to those ordinarily skilled in the art after reviewing the following detailed descriptions and accompanying drawings, in which.

DETAILED DESCRIPTION OF THE PREFERRED EMBODIMENT

Figure 1:
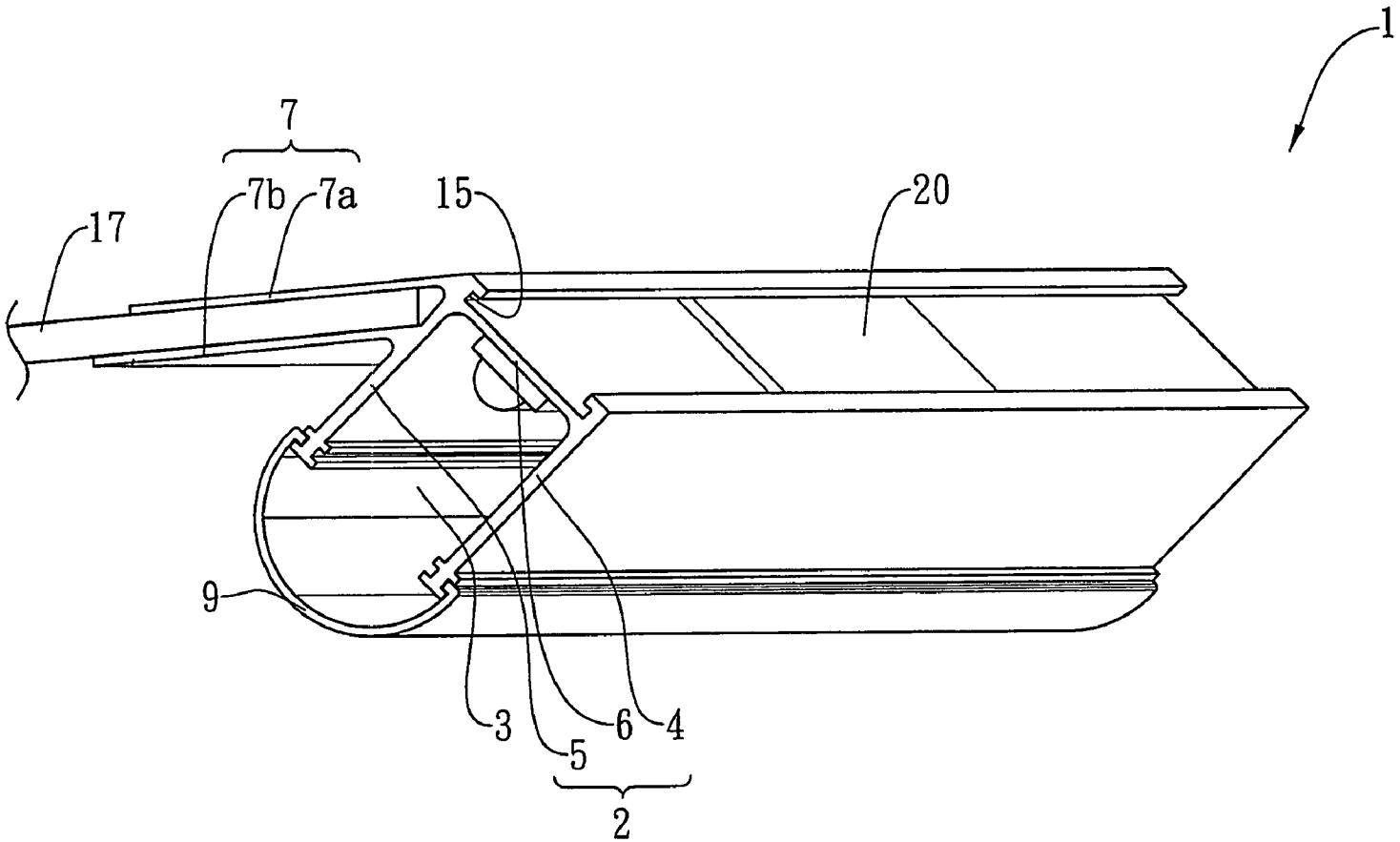
FIG. 1 is a perspective view of the lighting apparatus according to a first embodiment of the present invention.

With reference to the following disclosures combined with the accompanying drawings, the treating unit and apparatus having the same according to the present invention are illustrated and understood. It should be noted that the elements shown in the drawings are merely provided for illustration, but not limitation to the present invention, and the elements known by the skilled person in this art are omitted from the drawings for clarity.

Figure 2:
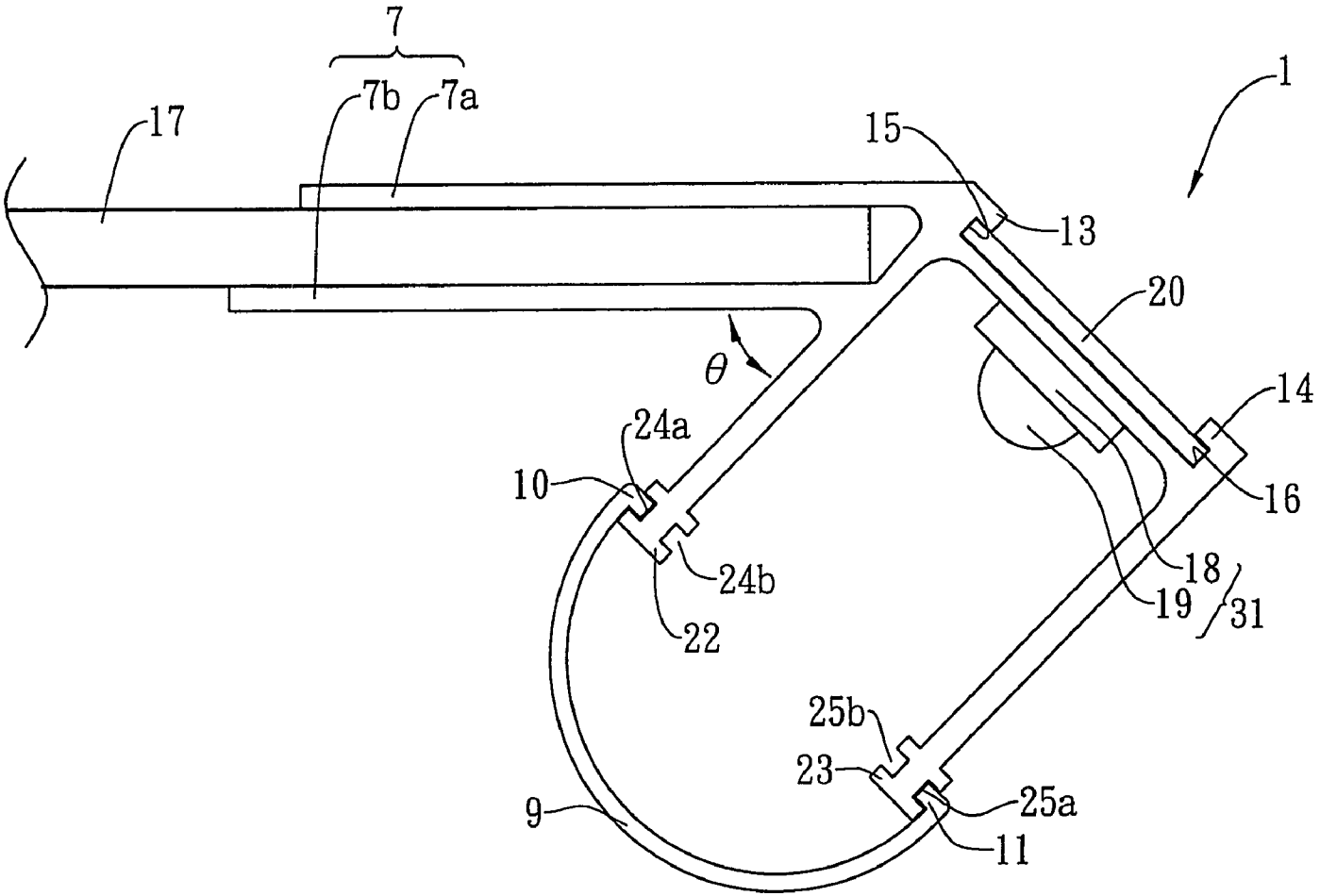
FIG. 2 is a side view of the lighting apparatus according to the first embodiment of the present invention.

Please refer to FIGS. 1 and 2 showing the perspective view and side view of the lighting apparatus according to a first embodiment of the present invention respectively. The lighting apparatus 1 of the present invention is installed in a refrigerated display cabinet for lighting the product stored therein, and includes a main frame 2 and a lampshade 9. The main frame 2 is constructed by three frame walls 4, 5 and 6, whereby an interior space 3 for receiving a lighting device, such as a light-emitting diode (LED) assembly 31, is defined. Typically the LED assembly 31 is constructed by a base 18 and an LED 19 thereon, and is attached onto the inner face, i.e. the face toward the interior space, of the frame wall 6. The main frame 2 also includes a heat-dissipating portion 7 extending from one side of the first frame wall 4. According to the present invention, the heat-dissipating portion 7 includes two heat sinks 7*a* and 7*b*, and is integrated with the main frame 2. The integrated main frame 2, including the frame walls 4, 5 and 6 and the heat sinks 7*a* and 7*b*, is fabricated using the metal extrusion process such as aluminum extrusion process. The lampshade 9, which is made of a transparent or translucent material, is engaged with the frame walls 4 and 5 at both rims 10 and 11 thereof, so as to cover the interior space receiving the LED assembly 31. In more specifics, the main frame 2 includes an outer engagement portion, i.e. the grooves 24*a* and 25*a* formed on the respective rims 22 and 23 of the main frame 2, such that the rims 10 and 11 of the lampshade 9 are engaged therewith.

In this embodiment, the two heat sinks 7*a* and 7*b* included by the heat-dissipating portion 7 are parallel to each other, and thereby function as a clamper for clamping a plate portion 17 of the refrigerated display cabinet. By clamping the plate portion 17, the lighting apparatus 1 of the present invention is detachably combined with the refrigerated display cabinet in a simple manner.

The heat-dissipating portion 7 is extending from one side of the frame wall 1 of the main frame 2 at an angle θ less than 90 degrees, such that the products stored in the refrigerated display cabinet is well-illuminated by the lighting apparatus 1. For showing the customer the information with respect to the products stored in the refrigerated display cabinet, a card or tag 20 providing such information is arranged on the surface of the frame wall 6 of the lighting apparatus 1. According to the present invention, the lighting apparatus 1 includes a holding portion for holding the card or tag 20 on the frame wall 6. The holding portion is formed by forming respective grooves 15 and 16 at the rims 13 and 14 of the main frame 2. In this case, the card or tag 20 is able to slide in the grooves 15 and 16 and be held therein.

Figure 3:
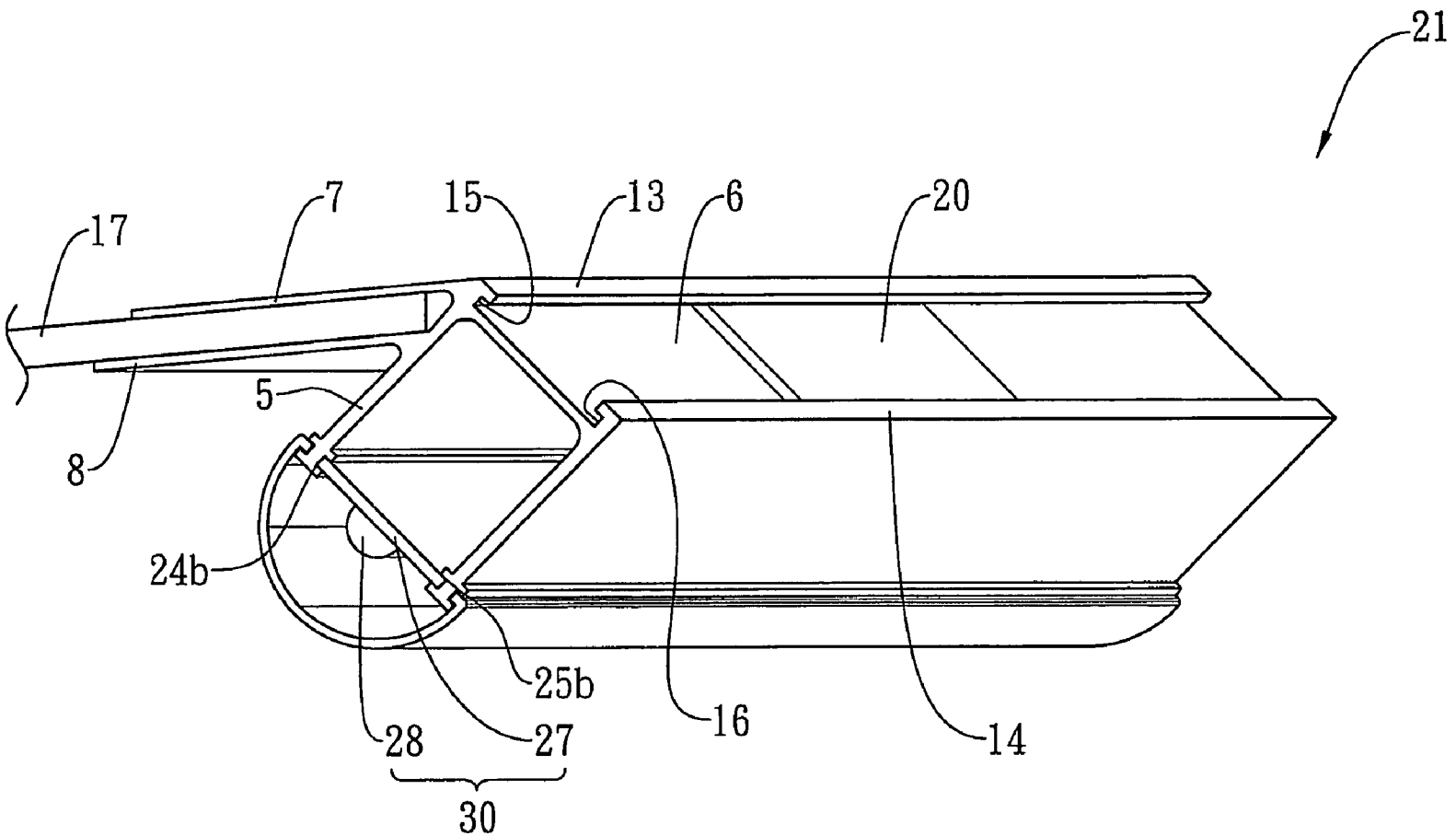
FIG. 3 is a perspective view of the lighting apparatus according to a second embodiment of the present invention.

FIG. 3 illustrates a lighting apparatus according to a second embodiment of the present invention. The construction of the lighting apparatus 21 is similar to that of the lighting apparatus 1 of FIG. 1, except for the following difference. In this embodiment, the LED assembly 30, including the base 27 and LED 28, is not attached on the frame wall 6, but is located within the interior space 3 by the engaging of the substrate 28 with the inner engagement portion, grooves 24*b* and 25*b*, of the main frame 2.

Figure 4:
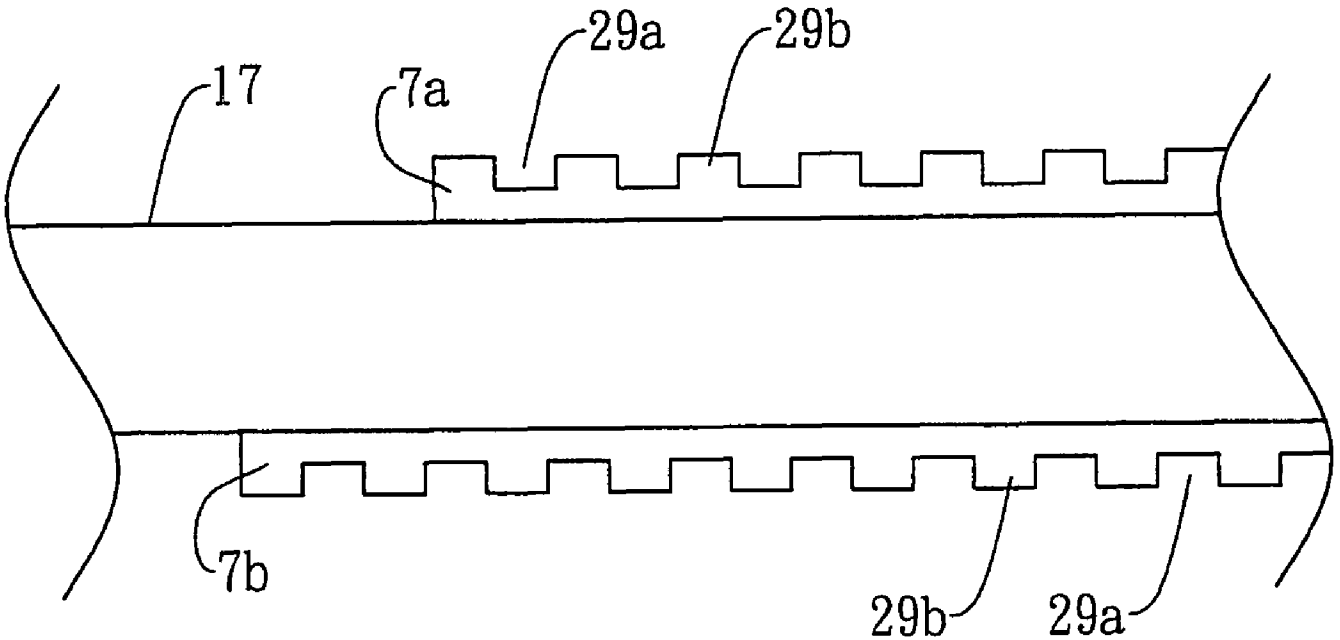
FIG. 4 is a schematic view showing the heat-dissipating portion integrated with the lighting apparatus according to the present invention.

In order to facilitate the thermal dissipation of the lighting apparatus of the present invention, the heat sinks 7*a* and 7*b* of the heat-dissipating portion 7 clamping the plate portion 17 of the refrigerated display cabinet is provided with plural grooves 29*a* or fins 29*b* formed thereon, as shown in FIG. 4. The dissipation efficiency is significantly enhanced due to the increasing of surface area of the heat sinks 7*a* and 7*b*.

Figure 5:
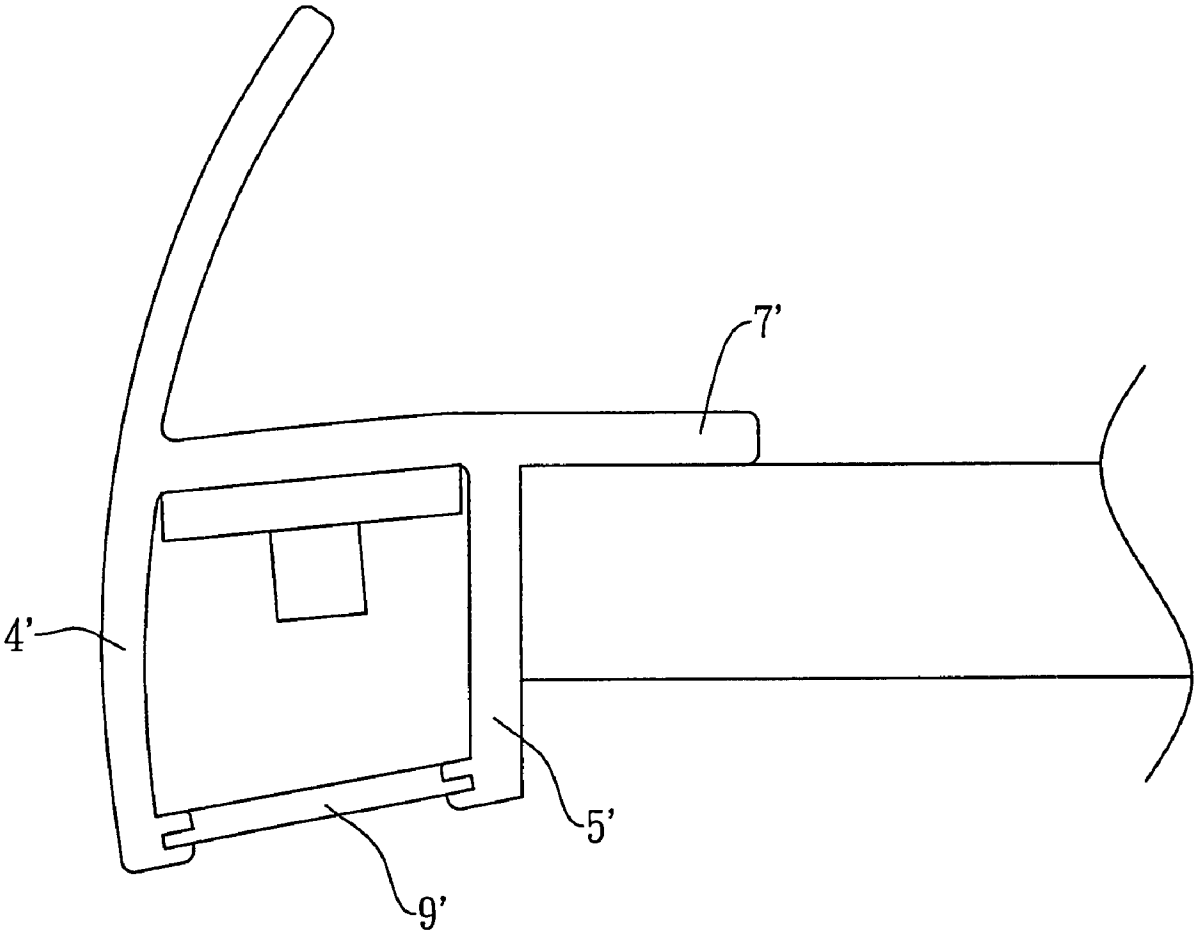
FIG. 5 is a side view of the lighting apparatus according to a second embodiment of the present invention.

With reference to FIG. 5, the lighting apparatus according to a second embodiment of the present invention is illustrated. In this embodiment, the components of the lighting apparatus are similar to those shown in FIGS. 1-4. The only difference resides in that the lighting apparatus as shown in FIG. 5 includes only one heat sink 7' which is extending from the second frame wall adjacent to the first frame wall 4', so that the lighting apparatus is detachably combined with the refrigerated display cabinet by simply attaching thereto by the heat sink 7', and if necessary, also by the third frame wall 5'. It would be appreciated that any fixing element or means known by the skilled person in this art, such as screwing with a bolt or magnetism suction, may be used for further securing the lighting apparatus to the refrigerated display cabinet.

By means of the present invention, the lighting apparatus for a refrigerated display cabinet is more compact in size and has simpler structure that makes assembly easier. Moreover, the lighting apparatus of the present invention is advantageous in terms of energy conservation. Through the integrated structure of main frame and heat-dissipating portion, which are fabricated in one-piece by the aluminum extrusion process, the heat produced by laminating of LED assembly is efficiently dissipated in a short time. Therefore, the lighting apparatus of the present invention is advantageous in increasing heat dissipation efficiency, lowering manufacture cost, simplifying assembly procedures, and making maintenance work more convenient.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. A lighting apparatus for a refrigerated display cabinet, comprising:

a main frame constructed by at least a first frame wall, a second frame wall adjacent to said first frame wall and a third frame wall adjacent to said second frame wall and opposite to said first frame wall, thereby defining an interior space for receiving a lighting device therein, and integrated with a heat-dissipating portion extending from a first side of said first frame wall;

a holding portion formed on a surface of said second frame wall for holding a card or a tag; and a lampshade configured for covering said interior space, wherein said heat-dissipating portion is configured to be detachably combined with said refrigerated display cabinet for mounting of the lighting apparatus, and said heat-dissipating portion is extending from said first frame wall at an angle less than 90 degrees relative thereto.

2. The lighting apparatus of claim 1, wherein said main frame comprises an engagement portion formed on a second side of said first frame wall and one side of said third frame wall corresponding to said second side of said first frame wall, and said lampshade is engaged with said engagement portion at a first rim and a second rim thereof.

3. The lighting apparatus of claim 1, wherein said heat-dissipating portion has a plurality of grooves or fins formed thereon.

4. The lighting apparatus of claim 1, wherein said heat-dissipating portion comprises a first and a second heat sinks which are parallel to each other, and said lighting apparatus is detachably combined with said refrigerated display cabinet by means of clamping by said first and second heat sinks.

5. The lighting apparatus of claim 1, wherein said heat-dissipating portion comprises a heat sink extending from said second frame wall, and said lighting apparatus is detachably combined with said refrigerated display cabinet by means of attaching thereto by said heat sink.

6. The lighting apparatus of claim 1, wherein said lighting device is a light-emitting diode assembly.

7. The lighting apparatus of claim 1, wherein said lampshade is made of transparent material or a translucent material.

* * * * *